US009429888B2

(12) United States Patent
Utsunomiya et al.

(10) Patent No.: US 9,429,888 B2
(45) Date of Patent: Aug. 30, 2016

(54) FIXING DEVICE AND IMAGE FORMING APPARATUS WHICH UTILIZES A NIP SUPPORTING MEMBER TO SUPPORT A NIP FORMING MEMBER

(71) Applicants: Kohichi Utsunomiya, Kanagawa (JP); Hideo Nagafuji, Kanagawa (JP); Yuji Arai, Kanagawa (JP); Arinobu Yoshiura, Kanagawa (JP); Kiho Sai, Tokyo (JP); Shohei Saito, Kanagawa (JP); Yutaka Ikebuchi, Kanagawa (JP); Motoyoshi Yamano, Kanagawa (JP)

(72) Inventors: Kohichi Utsunomiya, Kanagawa (JP); Hideo Nagafuji, Kanagawa (JP); Yuji Arai, Kanagawa (JP); Arinobu Yoshiura, Kanagawa (JP); Kiho Sai, Tokyo (JP); Shohei Saito, Kanagawa (JP); Yutaka Ikebuchi, Kanagawa (JP); Motoyoshi Yamano, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/792,870

(22) Filed: Jul. 7, 2015

(65) Prior Publication Data

US 2016/0011549 A1 Jan. 14, 2016

(30) Foreign Application Priority Data

Jul. 10, 2014 (JP) ..... 2014-142605
Apr. 15, 2015 (JP) ..... 2015-083730

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2089; G03G 15/2053; G03G 2215/2035; G03G 2215/2064; G03G 2215/2041
See application file for complete search history.

(56) References Cited

U.S. PATENT DOCUMENTS

| | | | |
|---|---|---|---|
| 7,437,110 | B2 | 10/2008 | Kondo et al. |
| 8,010,028 | B2 | 8/2011 | Shinshi |
| 2010/0290822 | A1 | 11/2010 | Hasegawa et al. |
| 2011/0058866 | A1 | 3/2011 | Ishii et al. |
| 2011/0076071 | A1 | 3/2011 | Yamaguchi et al. |
| 2011/0116848 | A1 | 5/2011 | Yamaguchi et al. |

(Continued)

FOREIGN PATENT DOCUMENTS

| | | |
|---|---|---|
| JP | 2007-233011 | 9/2007 |
| JP | 2007-334205 | 12/2007 |

OTHER PUBLICATIONS

Extended European Search Report issued Nov. 25, 2015 in Patent Application No. 15173742.6.

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P

(57) ABSTRACT

A fixing device includes an endless fixing belt: a fixing belt holding member; a pressure member that makes a contact with the circumference of the fixing belt; a nip forming member that is disposed inside the fixing belt and forms a nip between the nip forming member and the pressure member; a nip supporting member that is made of a sheet metal; a side plate that supports the fixing belt holding member and the nip supporting member; and a pressure mechanism that presses the pressure member against the nip forming member with the fixing belt between the pressure member and the nip forming member. Both end surfaces of the nip supporting member are shear surfaces and one of the shear surfaces makes a contact with the nip forming member and the other shear surface is supported by the side plate.

12 Claims, 10 Drawing Sheets

(56) References Cited

U.S. PATENT DOCUMENTS

2011/0129268 A1 6/2011 Ishii et al.
2011/0170920 A1* 7/2011 Fujiwara ..... G03G 15/2064 399/331
2011/0194870 A1 8/2011 Hase et al.
2011/0200368 A1 8/2011 Yamaguchi et al.
2011/0206427 A1 8/2011 Iwaya et al.
2011/0217093 A1 9/2011 Tokuda et al.
2011/0217095 A1 9/2011 Ishii et al.
2011/0222888 A1 9/2011 Ikebuchi et al.
2011/0222929 A1 9/2011 Fujimoto et al.
2011/0222930 A1 9/2011 Fujimoto et al.
2011/0229181 A1 9/2011 Iwaya et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0262193 A1 10/2011 Kimura
2011/0274453 A1 11/2011 Shimokawa et al.
2012/0121305 A1 5/2012 Yoshikawa et al.
2012/0155936 A1 6/2012 Yamaguchi et al.
2012/0177423 A1 7/2012 Imada et al.
2013/0045032 A1 2/2013 Shimokawa et al.
2013/0170879 A1 7/2013 Yoshinaga et al.
2013/0170880 A1 7/2013 Gotoh et al.
2013/0183071 A1 7/2013 Iwaya et al.
2013/0195493 A1 8/2013 Hase et al.
2013/0209125 A1 8/2013 Uchitani et al.
2013/0251390 A1 9/2013 Ishii et al.
2013/0322940 A1* 12/2013 Ichiki ..... G03G 15/2064 399/329
2014/0064804 A1 3/2014 Yamaguchi et al.
2014/0072355 A1 3/2014 Tamaki et al.
2014/0079424 A1 3/2014 Ikebuchi et al.
2014/0079453 A1 3/2014 Arai et al.
2014/0079455 A1 3/2014 Seki et al.
2014/0093288 A1 4/2014 Naitoh et al.
2014/0248072 A1 9/2014 Yoshinaga et al.
2014/0270820 A1 9/2014 Saito et al.
2014/0270832 A1 9/2014 Saito et al.
2014/0270833 A1 9/2014 Yuasa et al.
2014/0270872 A1 9/2014 Tamaki et al.
2015/0063884 A1 3/2015 Iwaya et al.

OTHER PUBLICATIONS

U.S. Appl. No. 14/790,297, filed Jul. 2, 2015, Utsunomiya, et al.
U.S. Appl. No. 14/793,949, filed Jul. 8, 2015, Utsunomiya, et al.

* cited by examiner

FIXING DEVICE AND IMAGE FORMING APPARATUS WHICH UTILIZES A NIP SUPPORTING MEMBER TO SUPPORT A NIP FORMING MEMBER

CROSS-REFERENCE TO RELATED APPLICATIONS

The present application claims priority to and incorporates by reference the entire contents of Japanese Patent Application No. 2014-142605 filed in Japan on Jul. 10, 2014 and Japanese Patent Application No. 2015-083730 filed in Japan on Apr. 15, 2015.

BACKGROUND OF THE INVENTION

1. Field of the Invention

The present invention relates to an image forming apparatus, such as a copy machine, a printer, or a facsimile machine. More specifically, the present invention relates to a configuration of a fixing device.

2. Description of the Related Art

A fixing device is known that includes cylindrical metal heat-conductive member and a heat source that are provided inside an endless belt that is heated via the metal heat-conductive member and further includes a pressure roller that makes a contact with the metal heat conductive member with the endless belt in between, thereby forming a nip part, in which the endless belt is caused to runs in the circumferential direction in accordance with the rotation of the pressure roller (see, for example, Japanese Laid-open Patent Publication No. 2007-334205). This configuration makes it possible to heat the whole endless belt that configures the fixing device, shorten the first print time from the heating stand-by time, and overcome the heat shortage upon high-speed rotation.

Another fixing device is known in which only a member that forms a nip, a member that supports the member, and a heart source that are provided inside an endless belt and thus the endless belt can be directly heated with the heat source to form a nip (see, for example, Japanese Laid-open Patent Publication No. 2007-233011). This configuration reduces the heat capacity around the heat source, thereby shortens the first print time from the heating stand-by time.

In the conventional configurations, a supporting member supporting a nip member has to penetrate through the inside of the belt and thus the supporting member is a double-supported beam that bears the load from the nip surface at both ends. In order to reduce the size of the fixing device and the extra heat capacity, it is preferable that the volume of the supporting member be small as possible; however, because the supporting member has to form a nip width while bearing the load applied from an elastic pressure roller, if the volume of the supporting member is reduced and accordingly the strength lowers, the center of the supporting member bends in the direction away from the nip surface and accordingly a uniform nip width in the longitudinal direction cannot be obtained.

As a method that solves this problem, a method can be assumed in which the center of a nip forming member or a supporting member in the longitudinal direction is formed convex against the nip surface to cancel the bend; however, it is required to form the convex part in an accuracy of 0.05 mm or smaller in order to obtain an even nip surface and thus it costs a lot due to the total inspection etc.

In view of the above-described conventional problems, there is a need to provide a fixing device that solves the above-described problem and increases the reliability of the parts with a configuration that allows forming of an accurate convex part relatively easily, which makes it possible to reduce the inspection costs, etc.

SUMMARY OF THE INVENTION

It is an object of the present invention to at least partially solve the problems in the conventional technology.

According to the present invention, there is provided a fixing device comprising: an endless fixing belt; a fixing belt holding member that holds the fixing belt; a pressure member that makes a contact with the circumference of the fixing belt; a nip forming member that is disposed inside the fixing belt and forms a nip by making a contact with the pressure member with the fixing belt between the nip forming member and the pressure member; a nip supporting member that supports the nip forming member and that is formed of a sheet metal; a side plate that supports the fixing belt holding member and the nip supporting member; and a pressure mechanism that presses the pressure member against the nip forming member with the fixing belt between the pressure member and the nip forming member, wherein both end surfaces of the nip supporting member are shear surfaces and one of the shear surfaces makes a contact with the nip forming member and the other shear surface is supported by the side plate.

The present invention also provides an image forming apparatus comprising the above-described fixing device according.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

With reference to the accompanying drawings, an embodiment for carrying out the invention will be described below.

An exemplary paper conveyance device and an image forming apparatus 100 using a fixing device and incorporating the paper conveyance device to which the invention is applied are used for printers: however, the invention is not limited to this and it covers copy machines, facsimile machines, and multifunction peripherals of copy machine and facsimile machine.

Figure 1:
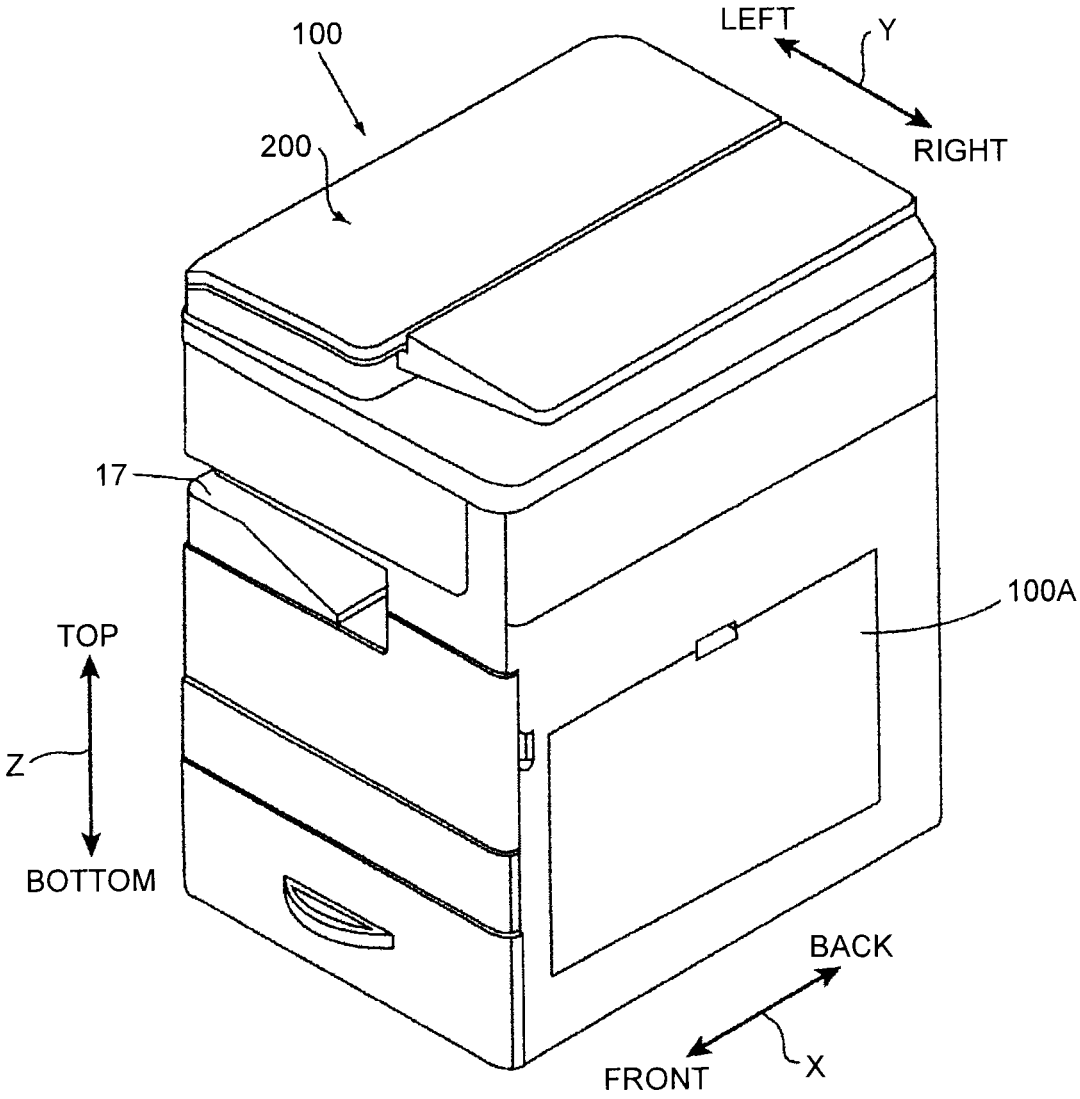
FIG. 1 is an exterior view of an image forming apparatus to which an embodiment of the present invention is applicable.

The body of the image forming apparatus 100 shown in FIG. 1 is configured of a casing that is a rectangular parallelepiped with an front-back direction serving as a first direction (direction denoted by the arrow X), a crosswise direction orthogonal to the first direction and serving as a second direction (direction denoted by the arrow Y), and a vertical direction serving as a third direction (direction denoted by the arrow Z).

In each of the directions, the direction indicated by the arrow X corresponds to the front-back direction of the image forming apparatus 100 and the direction of the width of paper serving as a recording medium parallel to the longitudinal direction of a fixing member and an opposing rotation member that are used for a fixing device 20 to be described below.

The image forming apparatus 100 mounts an original scanning device 200 at the top of an image forming unit, which will be described in detail below using FIG. 2, in the vertical direction (Z direction), and a paper ejection tray 17 used as an internal ejection unit is formed at the body top surface positioned under the original scanning device 200.

Figure 3:
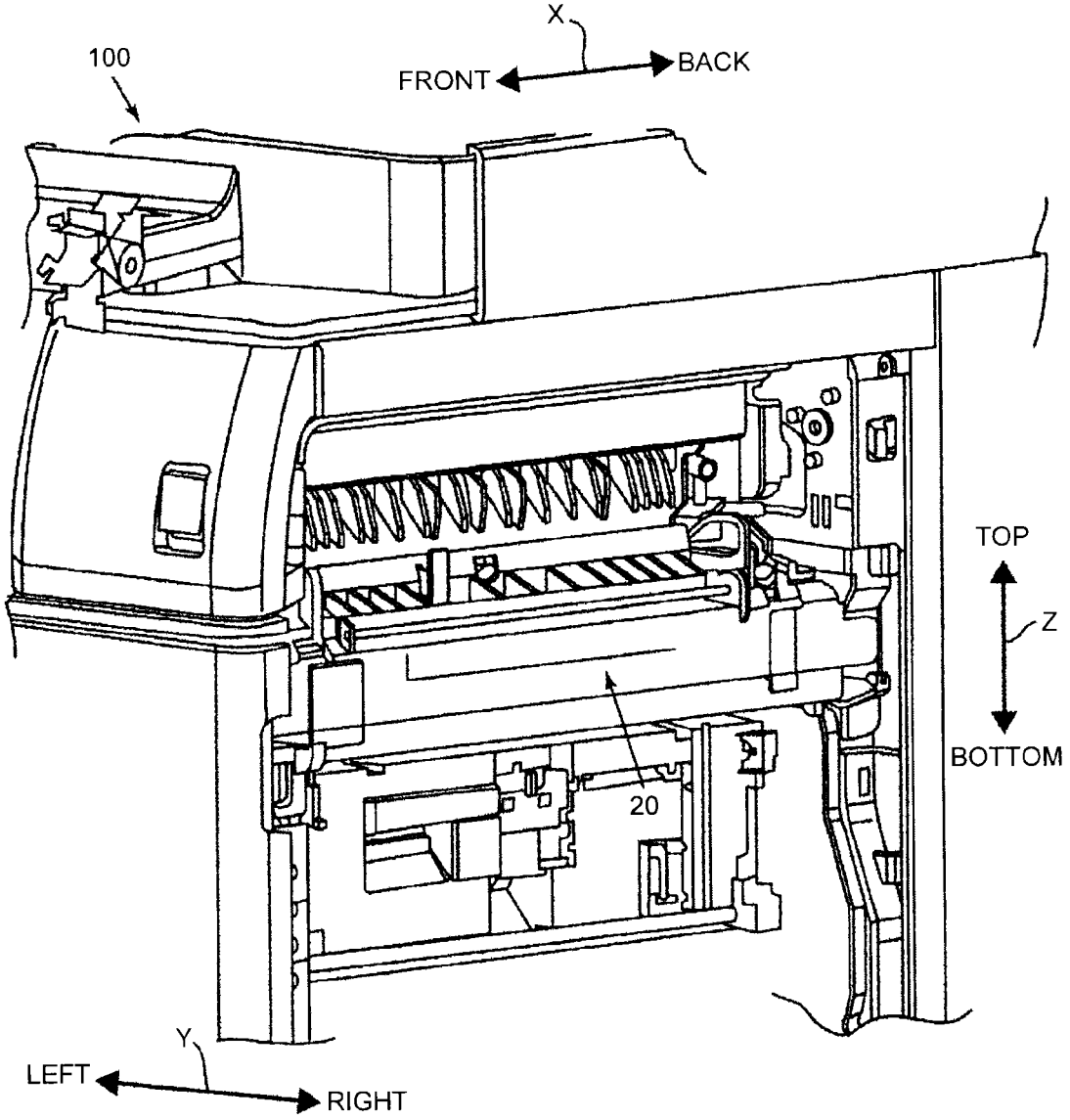
FIG. 3 is a an exterior view of the image forming apparatus without an exterior cover to which the embodiment of the invention is applicable.

On one side of the image forming apparatus 100 in the width direction (Y direction) that is the crosswise direction, an exterior cover 100A that is an openable and closable member is disposed. Opening the exterior cover 100A allows externally viewing of the fixing device 20 disposed inside as shown in FIG. 3.

Figure 2:
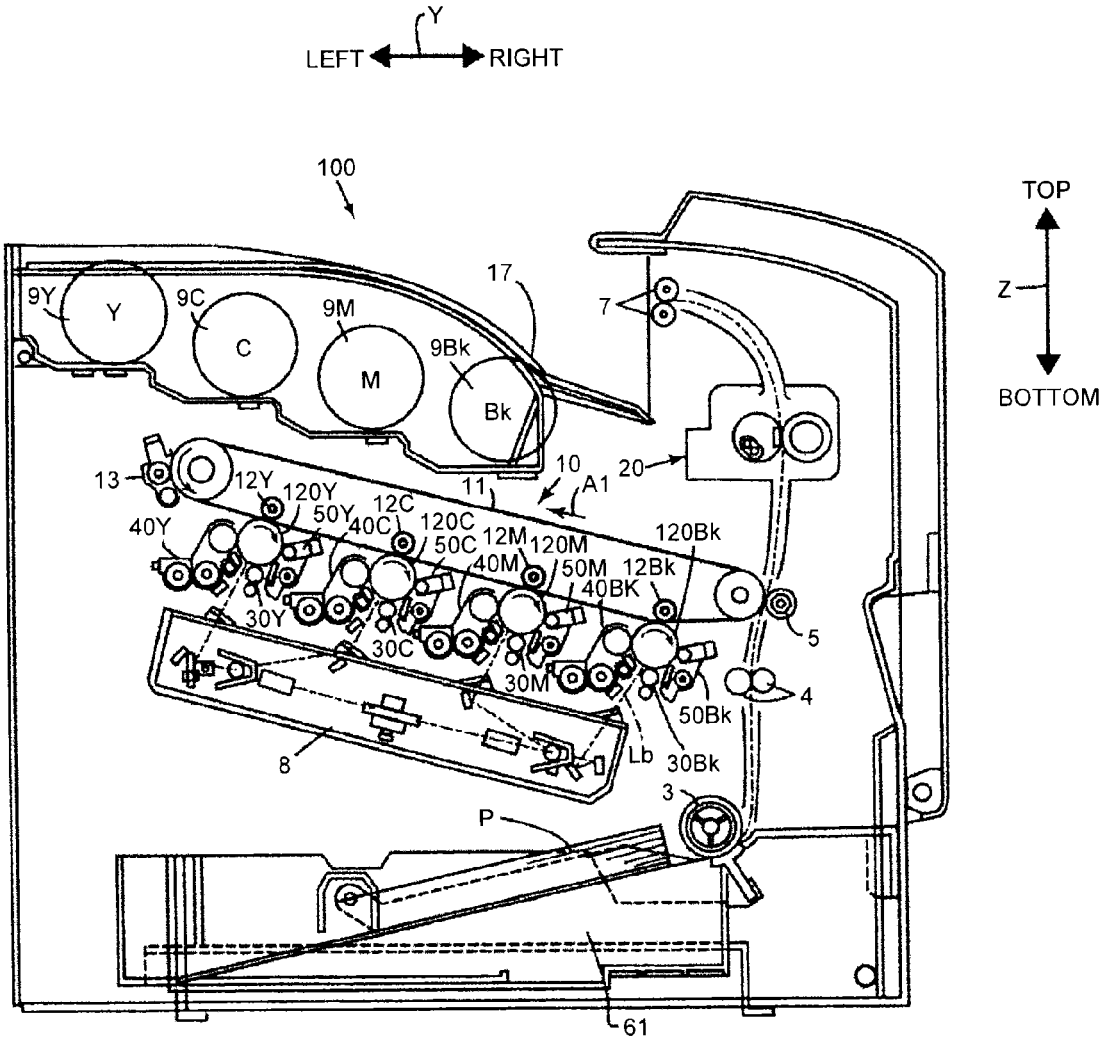
FIG. 2 is a schematic diagram of the image forming apparatus to which the embodiment of the invention is applicable.

The image forming apparatus 100 has the internal configuration shown in FIG. 2. Note that the original scanning device 200 shown in FIG. 1 is not shown in FIG. 2.

In the image forming apparatus 100 shown in FIG. 2, visible images formed on photosensitive drums 120Y, 120C, 120M, and 120Bk, respectively, are sequentially transferred onto a transfer belt 11 movable in the direction denoted by the arrow A1 while being opposed to the respective photosensitive drums. The transfer process corresponds to a primary transfer process where each image is sequentially transferred onto the transfer belt 11 so that superimposed transfer images are formed. Thereafter, by executing a secondary transfer process on paper P for which a recording sheet or the like is used, so that the superimposed transfer images are collectively transferred onto the paper P.

Devices for performing image forming processing according to the rotation of the photosensitive drum are disposed around each photosensitive drum 120. A photosensitive drum 120Bk that forms a black image is descried as follows. Along the direction of rotation of the photosensitive drum 120Bk, a charging device 30Bk, a developing device 40Bk, a primary transfer roller 12Bk, and a cleaning device 50Bk that perform the image forming processing are arranged. For writing after charging, an optical scanning device 8 to be described below is used.

In the superimposition transfer onto the transfer belt 11, during the process where the transfer belt 11 moves in the A1 direction, the visible images formed on the respective photosensitive drums 120 are sequentially transferred as superimposed onto the transfer belt 11. The primary transfer process is performed sequentially from the upstream to the downstream in the A1 direction depending on the transfer bias application using the the primary transfer rollers 12Y, 12C, 12M, and 12Bk that are disposed as opposed to the photosensitive drums 120 with the transfer belt 11 in between.

The photosensitive drums 120Y, 120C, 120M and 120Bk are each housed in a process cartridge and are arranged in this order from the upstream in the direction denoted by the arrow A1. The photosensitive drums 120 are respectively provided to image stations respectively for forming yellow, cyan, magenta and black images. For a configuration for executing the primary transfer process, a transfer belt unit 10 is used that includes the transfer belt 11 and the primary transfer rollers 12 opposed respectively to the photosensitive drums 120 with the transfer belt 11 in between. The images that are transferred as superimposed onto the transfer belt 11 are transferred collectively onto the paper P by a secondary transfer roller 5 configured of a roller that rotates according to the transfer belt 11.

The image forming apparatus 100 includes, in addition to the above-descried process cartridge and the transfer belt unit 10, the optical scanning device 8 serving as an optical writing device that is disposed as opposed to the bottoms of the four image stations and a cleaning device 13 for the transfer belt 11.

The optical scanning device 8 includes a semiconductor laser serving as a light source, a coupling lens, a fθ lens, a toroidal lens, a mirror, and a rotating polygon mirror. The optical scanning device 8 emits writing light Lb corresponding to each color to each photosensitive drum 120 (in FIG. 2, only the light from the image station for black image is denoted, but this applies to other image stations). Accordingly, a static latent image is formed on each photosensitive drum 120.

The following devices are used for the image forming apparatus 100.

The image forming apparatus 100 includes a sheet feeding device 61 that feeds paper P onto which images transferred as superimposed by the secondary transfer are collectively transferred and a registration roller pair 4 that sets the timing of registration on the paper P that is fed from the sheet feeding device 61 and feeds the paper P to a secondary transfer position. The image forming apparatus 100 further includes a sensor (not shown) that detects that the tip of the paper P has reached the registration roller pair 4.

The paper P with a toner image T obtained by the superimposition transfer onto the transfer belt 11 by the secondary transfer process is conveyed to the fixing device 20 (see FIG. 2) to be described below where the toner image is fixed. The paper P after the fixing is ejected to the paper ejection tray 17 provided outside the body of the image forming apparatus 100 via a paper ejection roller 7. The reference numerals 9Y, 9C, 9M and 9Bk denote new toner supply tanks for the respective developing devices provided to the respective image stations for the respective colors.

Figure 4:
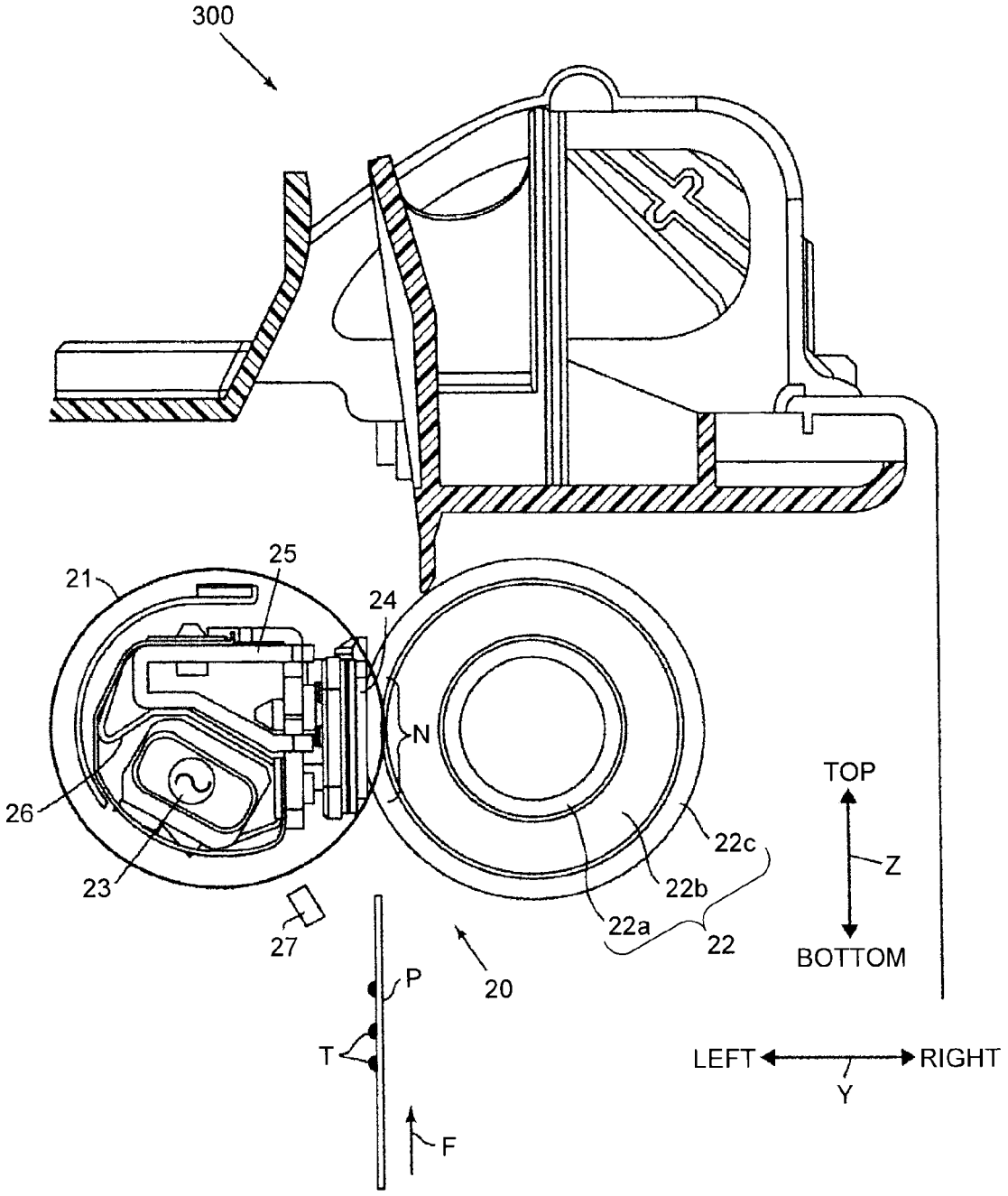
FIG. 4 is a schematic diagram illustrating an internal configuration of a fixing device that includes an exemplary paper conveyance device of the image forming apparatus to which the embodiment of the invention is applicable.

As shown in FIG. 4, the fixing device 20 is used to fix the toner image T after being transferred that is carried on the paper P by heat and pressure to melt the toner image T and permeate the toner image T through the paper P. The fixing device 20 includes a fixing belt 21 that is flexible and rotatable while being heated. The fixing device 20 includes, in addition to the fixing belt 21, a pressure roller 22 that is an opposite rotation member that causes a pressure between the pressure roller 22 and the fixing belt 21 while making a contact with the fixing belt 21 to form a nip part N. Inside the fixing belt 21, a heater 23 with a halogen lamp that serves as a heat source and that heats the area other than the nip part N, i.e., the area of the fixing belt 21 that circles at the side opposite to the nip part N, is disposed.

Inside the fixing belt 21, a nip forming member 24 that is a base member for forming a nip that is deposed inside the fixing belt 21, a stay 25 that supports the nip forming member 24, and a reflective member 26 that reflects light emitted from the heater 23 to the fixing belt 21 are disposed. Although the details are not shown, the nip forming member 24 that is a base member for forming a nip has a sliding sheet (low friction sheet) surrounding a base pad as a member that makes a contact with the fixing belt 21. The nip part N of the nip forming member 24 shown in FIG. 4 is platy, but the shape of the nip part N is not limited to this. For example, in a case where the nip part N is formed concave along the circumference of the pressure roller 22, the tip of the paper P that passes through the nip N is closer to the pressure roller 22, which is advantageous in that the separability from the fixing belt 21 increases.

The temperature of the fixing belt 21 is detected by a temperature sensor 27 disposed at a side at which the paper P enters the nip part and the temperature is used for feedback processing at the heater 23. The arrow F shown in FIG. 4 denotes the direction in which the paper P is conveyed. The fixing belt 21 is an endless belt that is thin, flexible, and formed sleeve-shaped. The fixing belt 21 consists of a base material and a releasable layer positioned at the top of the base material. For the base material, a metal material, such as a nickel or SUS, or a resin material, such as, polyimide is used. For the releasable layer, for example, tetrafluoroethylene-perfluoroalkyl vinyl ether copolymer (PFA) or polytetrafluoroethylene (PTFE) releasable from toner is used.

The pressure roller 22 includes a cored bar 22*a*, an elastic layer 22*b* consisting of foaming silicone rubber, silicone rubber, or fluoro-rubber and a releasable layer 22*c* provided at the surface of the elastic layer 22*b* and made of, for example, PFA or PTE. The pressure roller 22 is pressed against the fixing belt 21 by a pressing mechanism 204 to be described below and, in a state of making a contact with the fixing belt 21, makes a contact with the nip forming member 24 serving as a base member with the fixing belt 21 in between. At the part where the pressure roller 22 and the fixing belt 21 make a contact with each other, the elastic layer 22*b* of the pressure roller 22 is crushed so that a pressure is caused between the pressure roller 22 and the fixing belt 21 so that the nip forming member 24 keeps the nip part N with a predetermined width.

The pressure roller 22 is driven by a drive source, such as a motor (not shown) provided to the printer body, to rotate. When the pressure roller 22 is driven to rotate, the drive force is transmitted to the fixing belt 21 at the nip part N so that the fixing belt 21 is driven to rate. In the configuration shown in FIG. 4, the pressure roller 22 is a solid roller, but it may be a hollow roller. In such a case, a heat source, such as a halogen heater using radiation heat may be disposed inside the pressure roller 22. In the case where there is not the elastic layer 22*b*, the heat capacity reduces and the fixability increases; however, there is a possibility that, when unfixed toner is crushed to be fixed, fine unevenness on the surface of the belt is transferred onto the image and the gloss unevenness may occur in the solid part of the image. In order to prevent this, it is preferable that an elastic layer with a thickness of 100 μm or larger be provided. As a cylindrical metal used for the hollow roller, for example, aluminum, iron, or stainless may be selected. In the case where a heat source is provided inside the pressure roller 22, in order not to heat the supporting member by the radiant heat from the heat source, it is preferable that a heat-insulating layer be provided at the surface of the supporting member or a heat reflecting surface be provided by mirror surface processing. The heat source in this case is not limited to the halogen heater described above and it is also possible to use an IH heater, a resistance heating element or a carbon heater.

Figure 9:
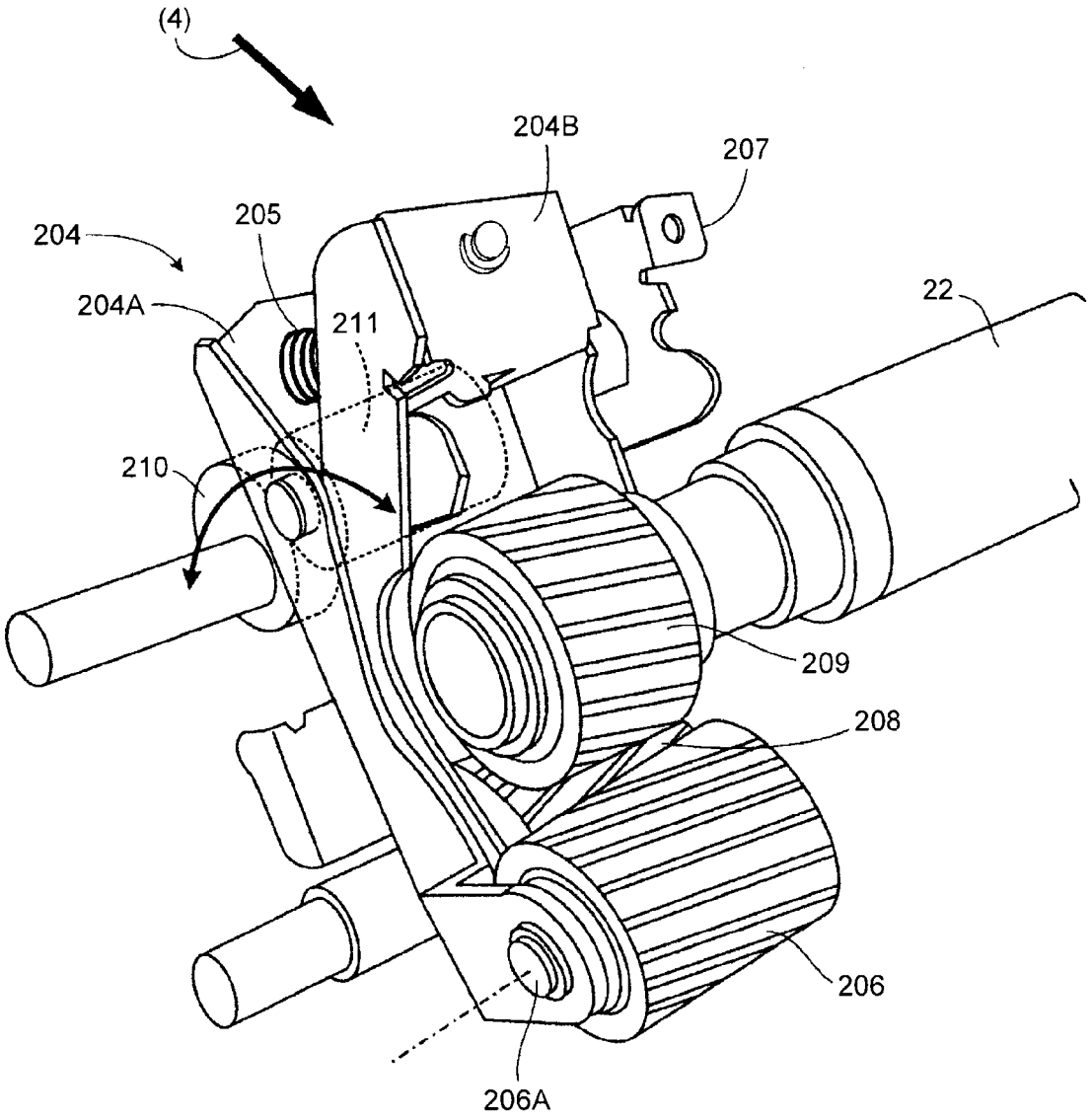
FIG. 9 is a schematic diagram illustrating a pressure mechanism used for the embodiment of the invention.

FIG. 9 shows the pressure mechanism 204 of the pressure roller 22. The pressure mechanism 204 includes a substrate 204A and a pressure roller urging plate 204B swingably supported by the substrate 204A. The pressure roller urging plate 204B is supported at the lower end of the substrate 204A serving as a swing fulcrum as shown in FIG. 9. A spring 205 arranged between the pressure roller urging plate 204B and the substrate 204A normally gives the swing end a behavior of swing toward the fixing belt 21.

At the bottom end of the substrate 204A, an input gear 206 to which the drive force is transmitted from the apparatus body is rotatably supported by a spindle 206A. An idle gear 208 that is provided to an attachment plate 207 used to attach the input gear 206 to the apparatus body is engaged with the input gear 206 and an output gear 209 that is supported on the same shaft as that of the pressure roller 22 is engaged with the idle gear 208. The substrate 204A and the pressure roller urging plate 204B can swing on a spindle 206A serving as a swing fulcrum as the arrow in FIG. 9 shows. The swing direction corresponds to the direction in which the pressure roller 22 is pressed against the fixing belt 21 to apply a pressure to the nip part and the direction in which the pressure is released from the nip part.

The operations of swinging the substrate 204A and the pressure roller urging plate 204B are performed by an eccentric cam 210 that is arranged on the swing end back side of the substrate 204A and a bearing 211 that is rotatably supported on the side of the substrate 204A so as to make a contact with the eccentric cam 210. In other words, when the large diameter part of the rotation phase of the eccentric cam 210 pushes and moves the bearing 211, the pressure roller 22 moves toward the fixing belt 21. Once the opposition position of the eccentric cam 210 with respect to the bearing 211 changes from the large diameter part to the small diameter part, the pressure roller 22 moves in a direction to such that the nip pressure is released.

The image forming apparatus 100 using the fixing device 20 configured as described above includes a paper conveyance device for conveying paper. An exemplary paper conveyance device 300 is aimed at paper that passes through the nip part N of the fixing device 20. As shown in FIG. 4, the paper conveyance device 300 configures a conveyance path for conveying the paper P that has passed through the nip part N sequentially to the outlet side of the fixing device 20 toward the paper ejection tray 17 (see FIG. 2).

The characteristics of the present invention according to the image forming apparatus 100 configured as described above will be described. In the above-described fixing device 20, as described in the section of "Description of the Related Art", it is required to form the convex part of the nip forming member 24 in an accuracy of 0.05 mm or smaller in order to obtain an even nip surface and thus it costs a lot due to the total inspection etc. A configuration that solves the problem will be described below.

Figure 5:
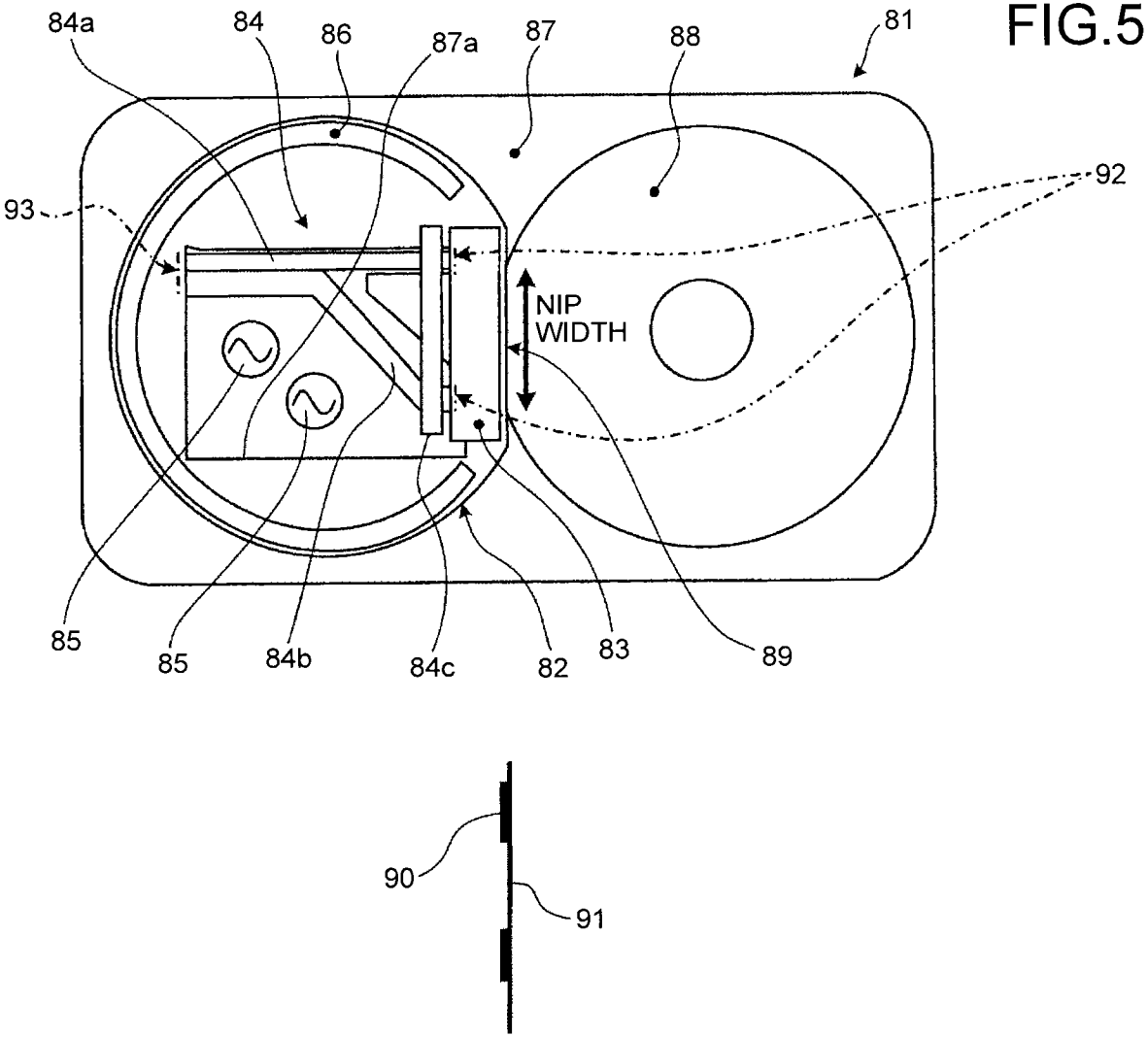
FIG. 5 is a schematic front cross-sectional view of a fixing device, illustrating an embodiment of the invention.
Figure 6:
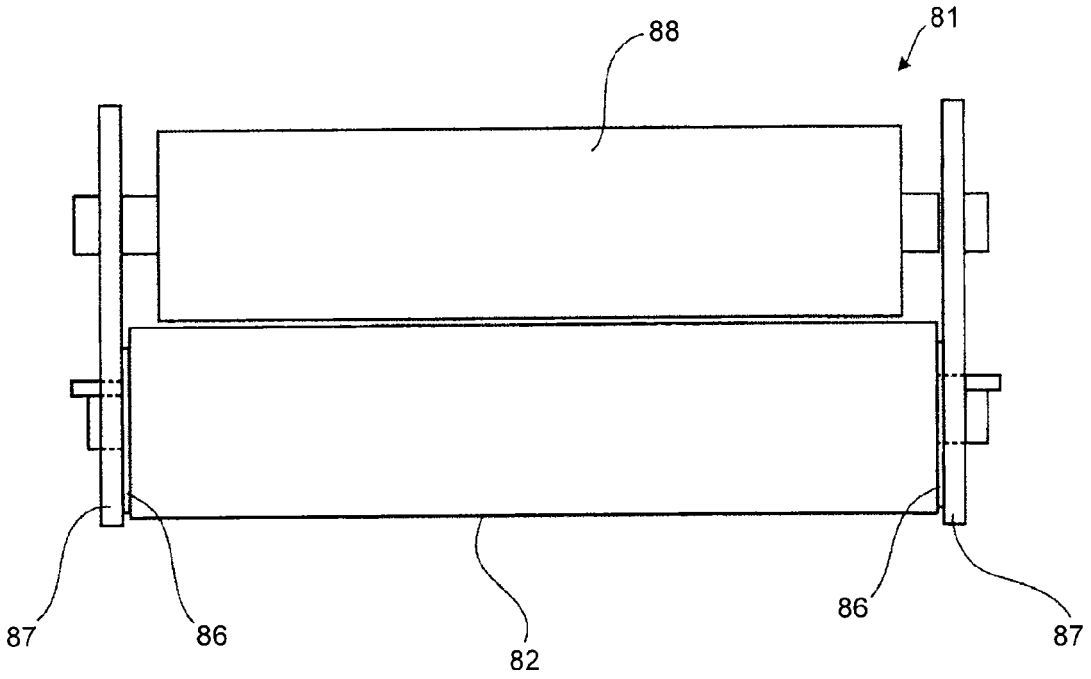
FIG. 6 is a schematic plane view of the fixing device, illustrating the embodiment of the invention.

FIGS. 5 and 6 shows a fixing device 81 used instead of the fixing device 20 in the embodiment of the present invention. The fixing device 81 includes a fixing belt 82 that is an endless belt. The fixing belt 82 includes therein a pad 83 that is a nip forming member, a stay 84 that is a nip supporting member that positions the pad 83, and a heater 85 that heats the fixing belt 82. Both ends of the fixing belt 82 are held by holders 86 serving as a fixing belt holding member and the stay 84 and the holders 86 are supported by side plates 87. At the front side of the fixing belt 82, a pressure roller 88 serving as a pressure member is disposed in a position where the pressure roller 88 is opposed to the pad 83 and the pressure roller 88 is pressed against the pad 83 by springs (not shown) provided near both ends of a spindle of the pressure roller 88, so that a nip surface 89 is formed.

According to the above-described configuration, in a fixing operation, the pressure roller 88 rotates clockwise as shown in FIG. 5 by the drive force from a drive mechanism (not shown), the fixing belt 82 runs in accordance with the rotation, and the heater 85 directly heats the fixing belt 82. Thereafter, passing through of paper is started when sufficient heat is stored. Specifically, paper 91 on which toner 90 has been transferred is conveyed from the lower part in FIG. 5 and the paper 91 passes through the nip surface 89 so that the toner 90 is fixed onto the paper 91.

In the above-descried fixing operations, when the nip width is narrow and the amount of heat applied to the toner 90 is too small, the toner 90 cannot sufficiently melt and thus the toner 90 cannot be fixed onto the paper 91. On the contrary, when the nip width is wide and the amount of heat applied to the toner 90 is too large, the toner 90 has excessive flowability over the rubbery state and thus the toner 90 cannot be fixed onto the paper 91. In order to prevent occurrence of such a problem, it is necessary to reduce unevenness in the nip width due to various factors. As exemplary nip width unevenness, a state can be exemplified where the stay 84 bends due to a load applied from the pressure roller 88 and the center nip width is narrowed, which causes a deviation in the nip width.

Figure 7:
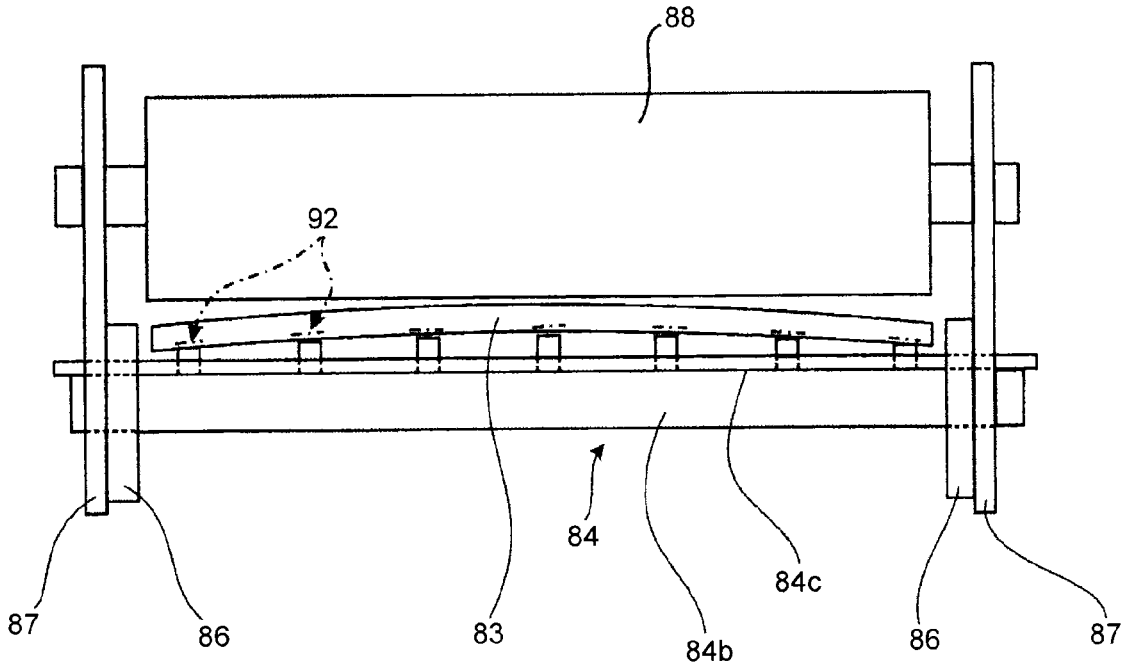
FIG. 7 is a schematic plane view of the fixing device without an endless belt, illustrating the embodiment of the invention.

In order to solve the above-described problem, according to the invention, pad supporting surfaces 92 of the stay 84 serving as one of shear surfaces are formed to be convex in a stepwise fashion from both ends in the longitudinal direction toward the center as shown in FIG. 7. This configuration cancels the bend of the stay 84.

Figure 8:
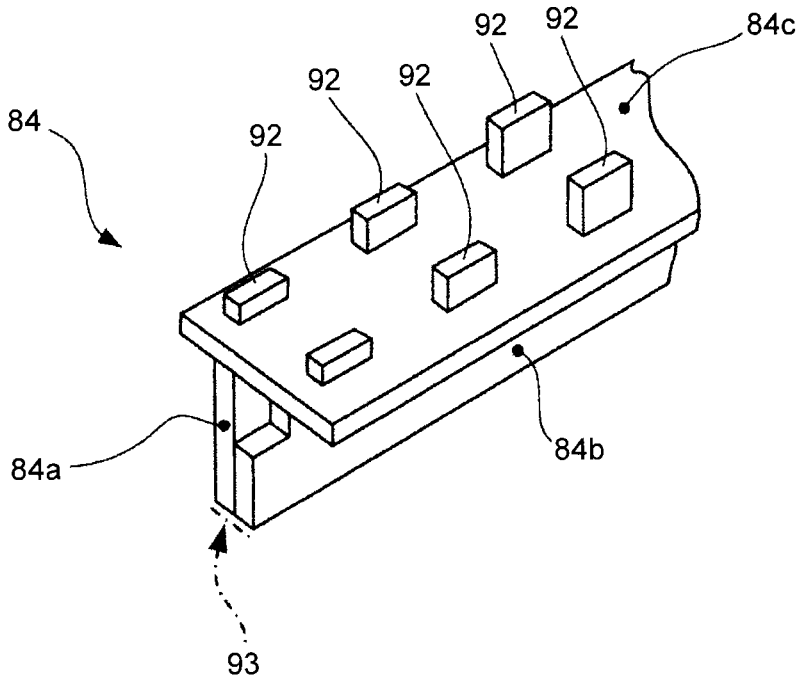
FIG. 8 is a schematic diagram illustrating a stay used for the embodiment of the invention.

The stay 84 includes a stay top 84*a*, a stay bottom 84*b*, and a stay right 84*c*. The stay top 84*a* is a steel plate member and its bottom surface shown in FIG. 8 is formed of a linear shear surface in the longitudinal direction. The top end surface of the stay top 84*a* shown in FIG. 8 is formed of a shear surface that is convex in a stepwise fashion from both ends in the longitudinal direction toward the center. The top end surface of the stay top 84*a* penetrates through the surface of the stay right 84*c* and this top end surface forms the pad supporting surfaces 92 serving as one of the shear surfaces. The stay bottom 84*b* is also a steel plate member and its bottom surface shown in FIG. 8 is formed of a linear shear surface in the longitudinal direction. Because the stay bottom 84*b* is bent midway, the top end surface of the stay bottom 84*b* is away from the top end surface of the stay top 84*a* by a given distance and is formed of a shear surface that is convex in a stepwise fashion from both ends in the longitudinal direction toward the center. The top end surface of the stay bottom 84*b* also penetrates through the surface of the stay right 84*c* and the top end surface forms the pad supporting surfaces 92 serving as one of the shear surfaces. The stay top 84*a* and the stay bottom 84*b* are fixed to each other by, for example, welding, bonding, calking, or screwing and the stay top 84*a* and the stay bottom 84*b* are fixed to the stay right 84*c* by, for example, welding, bonding, calking, or screwing. The bottom end surfaces of the stay top 84*a* and the stay bottom 84*b* configure the stay supporting surface 93 serving as the other shear surface and the stay supporting surface 93 is fitted to holes 87*a* formed in the side plates 87 so that the stay 84 is supported by the side plates 87.

According to the above-described configuration, the pad 83 can be positioned with the shear surface that is formed in the stay 84 formed of a metal plate with which dimensional accuracy is easily obtained, which makes it possible to easily form the accurate pad supporting surfaces 92. This makes it possible to provide a fixing device having the parts with increased reliability that can reduce the examination costs. Furthermore, by forming the pad supporting surfaces 92 to be convex in a stepwise fashion from both ends in the longitudinal direction toward the center, the nip deviation due to bending of the stay 84 can be canceled and thus an even nip can be obtained.

Figure 10:
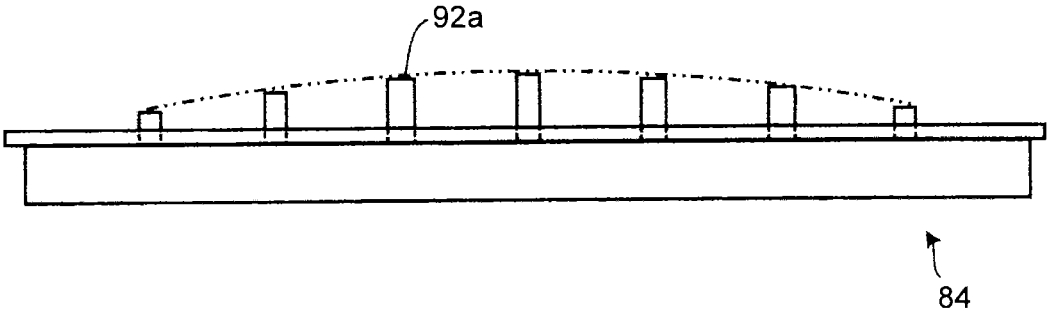
FIG. 10 is a schematic diagram illustrating a pad supporting surface used for a modification of the embodiment of the invention.
Figure 11:
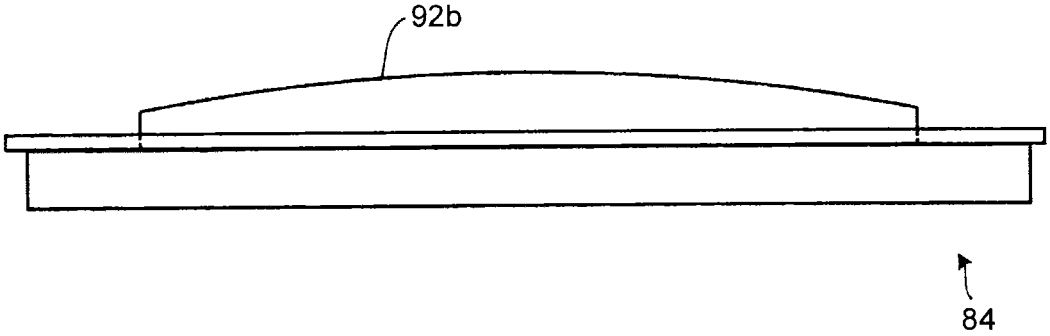
FIG. 11 is a schematic diagram illustrating a pad supporting surface used for another modification of the embodiment of the invention.

According to the above-described configuration, the pad supporting surfaces 92 are formed to be convex in a stepwise fashion from both ends in the longitudinal direction toward the center. Alternatively, instead of the pad supporting surfaces 92, a pad supporting members 92*a* formed to form an arc as shown in FIG. 10 may be used. This makes it possible to prevent the pad 83 from making a linear contact with the pad supporting surfaces 92*a* and obtain an even nip and thus prevent the pad 83 from being broken. According to the above-described configuration, multiple pad supporting surfaces 92 that are discontinuous and pectinate are formed. Alternatively, instead of the pad supporting surfaces 92, a pad supporting member 92*b* that is formed to be continuous as shown in FIG. 11 may be formed. Note that forming pad supporting surfaces separately allows independent fine adjustment of the shear surfaces, which makes it possible to easily secure the parts reliability. Furthermore, because the stay 84 consists of three metal plates of the stay top 84*a*, the stay bottom 84*b*, and the stay right 84*c*, the stay 84 can be formed of the minimum number of parts, which allows cost reduction and easy assembly.

According to an aspect of the embodiment, the nip forming member can be positioned by the shear surface that is formed in the nip supporting member formed of a metal plate with which dimensional accuracy is easily obtained, which makes it possible to easily form an accurate one of the shear surfaces. This makes it possible to provide a fixing device having the parts with increased reliability that can reduce the examination costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing belt;

a fixing belt holder that holds the fixing belt;

a pressure member to contact an outer portion of the fixing belt;

a nip forming member that is disposed inside the fixing belt and forms a nip by supporting the fixing belt, the fixing belt being between the nip forming member and the pressure member, the nip having a length direction which is perpendicular to a travel direction of a recording medium through the nip;

a nip supporting member that supports the nip forming member;

a side plate that supports the fixing belt holder and the nip supporting member; and a pressure mechanism that presses the pressure member against the fixing belt and towards the nip forming member, wherein the nip supporting member includes a planar surface having a first end and a second end which is opposite to the first end, the first end supporting the nip forming member and the second end supported, in a direction perpendicular to the length direction of the nip, by the side plate.

2. The fixing device according to claim 1, wherein the first end of the nip supporting member is convex in a stepwise fashion from ends of the nip supporting member in a longitudinal direction toward a center of the nip supporting member.

3. The fixing device according to claim 2, wherein the first end of the nip supporting member includes a shape of an arc.

4. The fixing device according to claim 1, wherein the first end of the nip supporting member includes a shape which is discontinuous and pectinate.

5. The fixing device according to claim 1, wherein the nip supporting member comprises three metal plates.

6. An image forming apparatus comprising the fixing device according to claim 1.

7. A fixing device comprising:

an endless fixing belt;

a fixing belt holder that holds the fixing belt;

a pressure member to contact an outer portion of the fixing belt;

a nip forming member that is disposed inside the fixing belt and forms a nip by supporting the fixing belt, the fixing belt being between the nip forming member and the pressure member;

a nip supporting member that supports the nip forming member;

a side plate that supports the fixing belt holder and the nip supporting member; and a pressure mechanism that presses the pressure member against the fixing belt and towards the nip forming member, wherein the nip supporting member includes a first element and a second element which is substantially perpendicular to the first element, a first end of the first element protruding though the second element, the first end of the first element directly supporting the nip forming member and a second end of the first element which is opposite to the first end of the first element being supported by the side plate.

8. The fixing device according to claim 7, wherein the first end of the first element of the nip supporting member is convex in a stepwise fashion from ends of the first element in a longitudinal direction toward a center of the nip supporting member.

9. The fixing device according to claim 8, wherein the first end of the first element of the nip supporting member includes a shape of an arc.

10. The fixing device according to claim 7, wherein the first end of the first element of the nip supporting member includes a shape which is discontinuous and pectinate.

11. The fixing device according to claim 7, wherein the nip supporting member comprises three metal plates.

12. An image forming apparatus comprising the fixing device according to claim 7.

* * * * *